US007547159B1

(12) United States Patent
Warters

(10) Patent No.: US 7,547,159 B1
(45) Date of Patent: Jun. 16, 2009

(54) CRADLE BOAT LIFT STORM PROTECTION SYSTEM

(76) Inventor: Helen Doro Warters, 976 SE. 9th Ave., Pompano Beach, FL (US) 33060

( * ) Notice: Subject to any disclaimer, the term of this patent is extended or adjusted under 35 U.S.C. 154(b) by 306 days.

(21) Appl. No.: 11/583,672

(22) Filed: Oct. 19, 2006

Related U.S. Application Data

(60) Provisional application No. 60/785,244, filed on Mar. 23, 2006.

(51) Int. Cl.
*B63C 3/06* (2006.01)

(52) U.S. Cl. ..... 405/3; 405/211; 114/44; 70/57

(58) Field of Classification Search ..... 405/1, 405/3, 211; 114/44; 70/57
See application file for complete search history.

(56) References Cited

U.S. PATENT DOCUMENTS

| | | | | |
|---|---|---|---|---|
| 3,177,668 | A * | 4/1965 | Schneider et al. | 405/3 |
| 6,032,601 | A * | 3/2000 | Gates | 114/45 |
| 6,575,661 | B1 * | 6/2003 | Phillips et al. | 405/3 |
| 6,904,857 | B1 * | 6/2005 | Holden | 114/51 |
| 2002/0150427 | A1 * | 10/2002 | Godbersen | 405/3 |

* cited by examiner

*Primary Examiner*—Tara Mayo-Pinnock

(57) ABSTRACT

An add-on structure for cradle boat lifts incorporating a piling brace that, when hurricane winds threaten, provides for the interconnection of the pilings to the cradle of a cradle boat lift. One or more piling braces span the distances between the inboard pilings and the cradle beams. The outboard piling braces are similarly configured. Cradle brackets attach to the cradle and provide for the crosswise attachment of the piling brace to the cradle beam. The piling braces are permanently attached to the piling or intermittently secured by U-bolt to piling pads, which are permanently secured to the pilings.

10 Claims, 4 Drawing Sheets

CRADLE BOAT LIFT STORM PROTECTION SYSTEM

CROSS-REFERENCE TO RELATED APPLICATIONS

This application claims the benefit of PPA Ser. No. 60/785,244, filed 2006 Mar. 23 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This invention generally relates to cradle boat lifts, specifically to providing an add-on structure to cradle boat lifts that eliminates the swinging motion of cradle boat lifts during high wind conditions.

2. Discussion of Prior Art

A boat is typically lifted from water by positioning a cradle below the surface of the water and positioning a floating boat above the cradle. Cables, engaged by pulleys, lift the cradled boat out of the water. A typical cradle is square or rectangular in configuration, and includes a pair of longitudinally disposed, transversely spaced apart, frame members that are interconnected to one another at their respective opposite ends by transversely disposed braces. Cable-engaging pulleys are mounted at opposite ends of each frame member or cradle beam. Overhead motorized winches, mounted on pilings or other suitable support surfaces, are used to raise and lower the cradle.

A conventional cradle boat lift includes four (may also be 6 or 8) pilings that are driven into a sea bed adjacent a pier, wharf, or dock in a generally square or rectangular array. A first pair of pilings is positioned close to the dock. The second pair is positioned away therefrom by a distance substantially equal to the width of a boat and a reasonable amount of clearance. A first winch surmounts the first or inboard set of pilings and a second winch surmounts the second or outboard set.

A boat is positioned between the inboard and outboard pilings, above a pair of cradle beams, such that its longitudinal axis is substantially parallel to a first centerline drawn through the first set of pilings and therefore substantially parallel to a second centerline drawn through the second set of pilings. Four upstanding guide poles are mounted to the cradle beams to guide the boat to its proper position.

Cradle boat lift owners enjoy the convenience of simple, waterway yet, out of water, storage for their boats. Both the boat and the lift parts are stored out of water, protecting them from excessive wave action, corrosive saltwater damage and crustacean growth.

Davits and elevator lifts are alternative designs of residential boat lift structures. One or two davits can be used to lift the boat and swing it onto land. This method requires a landing for the boat, for protection from grass and mud, and uses up back yard space. Davits can be tricky to use. Clearly, a boat swinging on a lifted cable is potentially dangerous and vulnerable. Elevator lifts employ a cradle attached to angled beams along the sea wall. The lift motor raises the cradled boat along the beams and up, out of the water. Unfortunately, the elevator lift employs metal beams that remain in the water, exposed to water and especially salt water's corrosive properties. Davits and elevator lifts provide one or two points of strength, compared to the cradle boat lift's usual minimum of four points of strength.

Owners of cradle boat lifts enjoy the benefits of simple, safe, waterway access and storage for their boats. Vessels are protected from floating debris and free from concerns over excess wave action. The boat owner's maintenance costs are decreased due to the elimination of corrosive saltwater damage and crustacean growth on the hull and boat lift elements experienced by boats stored floating or on elevator lifts in the waterways. Because of these abundant benefits, recreational boaters who are fortunate enough to live on or own property along navigable water are having more and more multi-post cradle boat lifts installed each year.

All is well until tropical storm or hurricane force winds are experienced. Unfortunately, the cables that so conveniently allow the boat to be raised and lowered from the water, can also allow the cradle to swing dramatically when exposed to high wind conditions. The boat and lift repeatedly swing and slam as the storm rages. Damage can occur to the boat lift, dock, pilings, guide poles, and both sides of the boat.

When hurricane force winds are expected, cradle boat lift owners are recommended to remove their boat from the lift and put it on land in preparation for hurricane force winds. While prudent, this plan is not practical for many boaters. Boaters are reluctant to go to the expense and effort of having a trailer and trailer vehicle available for hauling their boat from the water and insuring a space on land to secure the boat. In recent years, multiple hurricanes have been anticipated each year. Each hurricane's predicted cone of possibility has spanned hundreds of miles in the Atlantic and Gulf state regions where many homesteads on navigable water exist. The process of repeatedly hauling a boat to dry ground in preparation for hurricanes that are predicted, but may not even materialize, is cumbersome, expensive, time-consuming and downright frustrating.

Mooring boats in the water is the second recommendation for storm preparation. However, special knowledge is needed to successfully use lines to allow for adequate scope for storm surge and wave action, while limiting the boat's scope from hitting seawalls, trees, neighboring boats or other dangers. The mooring option also exposes the boat to floating debris that can be expected to randomly occur in hurricane conditions.

If rejecting the previous hurricane preparation options, boaters are recommended to raise their boat lift to a high level, storm level, and strap the boat to the lift. Raising the boat to storm level serves two purposes: (1) to shorten the length of the cable wires and therefore the potential swing of the boat lift and (2) to raise the boat as far above sea level as possible to minimize the effects of storm surges and oversized floating debris. Unfortunately, even at storm level, hurricane force winds can cause the cradle to swing and slam the boat, exposing the boat owner to potentially expensive damage to the boat lift, dock, pilings, guide poles, and both sides of the boat.

To overcome this swinging motion, some cradle boat lift owners have used lines to tie the boat lift to the pilings in various ways. This process is time and line consuming. It often requires 2 persons to execute or one person who is willing to repeatedly climb off and on a lifted boat to attach the lines to the boat, lift and pilings. Paradoxically, lines are manufactured to stretch. This property, while very useful in everyday boating, makes it difficult to achieve a tight connection. Once the storm hits, hurricane winds are likely to stretch the lines and allow potentially damaging movement to still occur before the wind event is over.

All of the above methods of storm preparation, while inconvenient, are obvious steps for the boater to consider. Taking the next step, adding-on strength to the lift, is not obvious, nor simple to achieve and is therefore a new and innovative solution.

OBJECTS AND ADVANTAGES

Accordingly, several objects and advantages of my invention are:

1. To add structure to a cradle boat lift, preventing the potentially damaging, swinging motion of the cable and cradle members experienced in high wind conditions.
2. To provide a hurricane solution for cradle boat lifts that will not loosen in the storm.
3. To connect the cradle of the boat lift and pilings together, making a more durable, rigid, and hurricane ready structure.
4. To provide a one person lockdown capability.
5. To provide a hurricane preparation solution where no special knowledge is required. With this invention, raising the boat lift and securing simple hardware locks the structure together.
6. To provide a speedy, simple and highly effective method to secure the boat and lift for the intermittent occurrence of high wind warning.
7. To provide a similarly speedy and simple method to return the boat to day-to-day fair weather mode.
8. To provide a solution where all parts stay permanently secured to the lift, speeding the storm protection process and simplifying the storm protection plan.
9. To offer boat owners the convenience of on-lift, on-demand, waterway storm security for their boat.
10. To eliminate the hours, expense and hassles of storm protection preparation spent on trailers, hauling, on-land storage, or on-water mooring.

Other objects and advantages are:

1. That the invention is designed to be adjustable. If the lift measurement's change due to stretching cables, or a boat's realignment of weight, the design can compensate for the changes.
2. That the user is enabled to speedily engage storm protection mode as often as desired.
3. For boat owners with dual residence, this invention provides a consistent, safe means to protect the boat and lift for the entire hurricane season, if desired.

Further objects and advantages will become apparent from a consideration of the ensuing description and drawings.

SUMMARY

The Cradle Boat Lift Storm Protection System, adds piling braces and cradle brackets to any cradle boat lift. Piling braces are mounted to and along each set of inboard and outboard pilings respectively. The piling braces are mounted to the pilings, just above the raised level of the cradle beams appropriate for storm preparation. One cradle bracket is added to each end of the cradle beams, between the cable pulley and the guide pole. At installation, each cradle bracket is aligned to meet the piling brace when the lift is raised to storm level. The components are fastened together. Once secured, the cradle is unable to swing in any direction.

With this invention's piling braces and cradle brackets installed, it is a simple, one person process to change the lift from its standard, fair weather operating mode, to its storm protection configuration. Additionally, the system links the boat lift's pilings and the cradle lift's assembly together, both eliminating the swinging effect and stiffening the piling system.

The need for the Cradle Boat Lift Storm Protection System arises from the occurrence of two phenomena; the recent explosion of cradle boat lifts being installed in navigable waterways and the recent weather patterns. Experts predict an increase in hurricane activity for the next decade or two. A deficiency has been identified in the boating industry. It is the need to storm secure cradle boat lifts, easily and solidly. The invention has been implemented in hurricane conditions (Wilma 2005; Pompano Beach, Fla.) on a 10,000 lb. cradle boat lift. The 22 foot boat remained stationary on the lift through the storm while neighboring unprotected cradle boat lifts and boats were seen swinging forcefully as the wind was repeatedly slamming the guide poles into their boat and cradle beams into their docks.

DRAWINGS

Figures

DRAWINGS PREFERENCE NUMERALS

A. Cradle boat lift reference numerals

Figure 1:
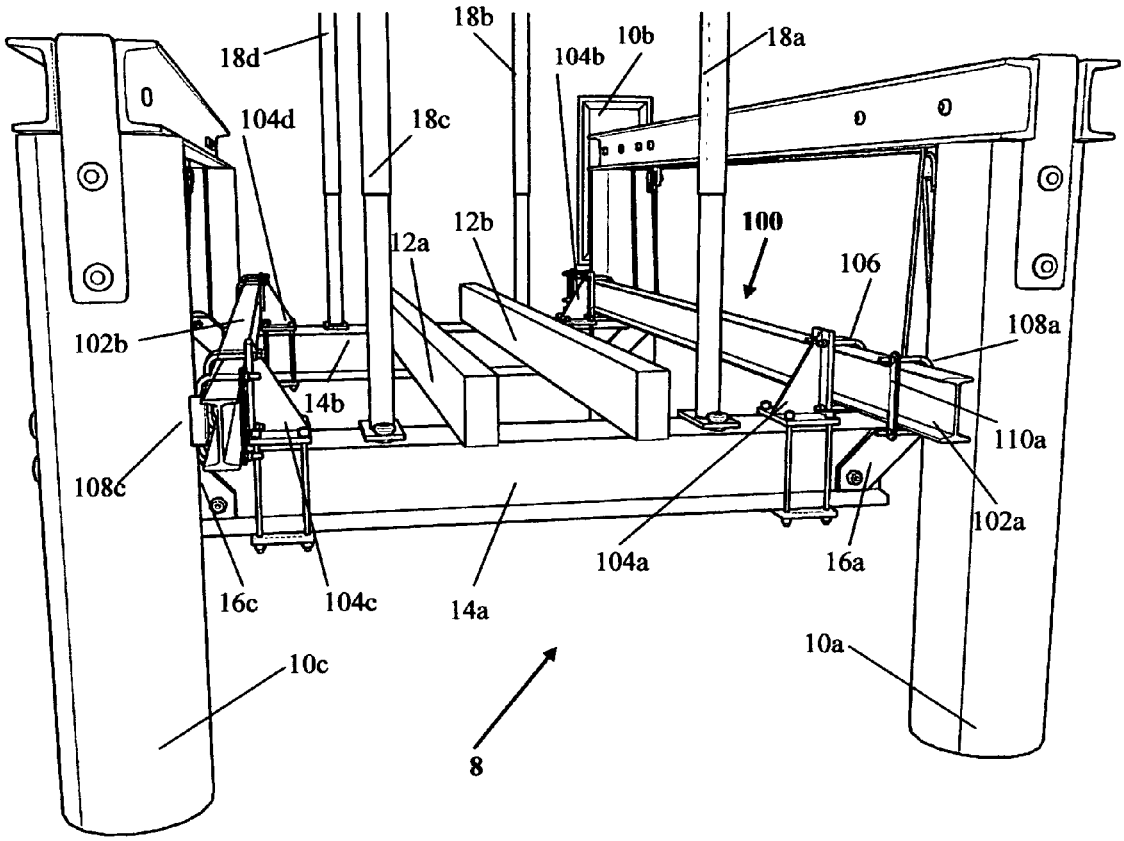
FIG. 1 is a rear view of a cradle boat lift equipped in accordance with the invention, showing the storm protection system in storm protection mode.

| | | | |
|---|---|---|---|
| 8 | Cradle boat lift or boat lift | | |
| 10a-d | pilings (4) | 12a,b | bunk boards (2) |
| 14a,b | cradle beams (2) | 16a-d | pulleys (4) |
| 18a-d | guide poles (4) | | |

B. Cradle Boat Lift Storm Protection System (SPS) Reference Numerals

| | |
|---|---|
| 100 | Storm Protection System or SPS |
| 102a,b | piling braces (2) |
| 104a-d | cradle brackets (4) |
| 106 | U-bolts (16) |
| 108a-d | piling pad (4) |
| 110a-d | washer plate (4) |
| 302a-d | cradle bracket bottom plate (4) |
| 402 | piling pad aluminum channel |
| 404 | piling pad extender plate |
| 406 | piling pad u-bolt |

DETAILED DESCRIPTION

Preferred Embodiment—FIGS. 1-4

FIG. 1 is a perspective view, seen from the back of a cradle boat lift of the Storm Protection System (SPS) installed in accordance with the invention. A group of parts comprising the Storm Protection System or SPS 100 is denoted as a whole. A cradle boat lift or boat lift 8 is also denoted as a whole. Boat lift 8 includes a set of four pilings 10*a*, 10*b*, 10*c*, and 10*d* or pilings a-d, positioned in a rectangular configuration. Pilings 10*a* and 10*b* or pilings 10*a,b* are referred to as inboard pilings as they are placed close to the dock, seawall, or other mooring facility alongside which the boat is to be moored. Pilings 10*c,d* are referred to as outboard pilings because they are placed away from the mooring facility, out in the waterway.

Boat lift 8 also includes a pair of parallel frame members, cradle beds or bunk boards 12*a,b* placed in the center of boat lift 8 which engage the hull of the boat when the boat lift 8 raises a boat above water level. Below and perpendicular to bunk boards 12*a,b* are a pair of parallel cradle frame members, cradle beams 14*a,b*. Bunk boards 12*a,b* are secured to cradle beams 14*a,b*, creating the boat's cradle.

A set of four cable engaging pulleys or pulleys 16*a-d*, partially visible in this view, are mounted at opposite ends of each cradle beam 14*a,b*. A set of four guide poles 18*a-d*, are secured to each end of the cradle beams 14*a,b* outside of bunk boards 12*a,b*. The guide poles 18*a-d* are positioned to direct the captain of a floating boat into position above the bunk boards 12*a,b* for lifting from the water.

Continuing discussion of FIG. 1, the SPS 100 is installed onto the above described boat lift 8. A piling brace 102*a* rests on top of and perpendicular to cradle beams 14*a,b* between pulleys 16*a,b* and guide poles 18*a,b*. Piling brace 102*a* passes next to and along inboard pilings 10*a* and 10*b* and has sufficient length to traverse the distances between each piling 10*a,b* and cradle braces 14*a,b*. A second piling brace 102*b* rests on the outboard end of cradle beams 14*a* and 14*b*, next to and along outboard pilings 10*c* and 10*d* with sufficient length to traverse the distances between each piling 10*c,d* and cradle braces 14*a,b*.

A pressure treated 2"×6"×12'6" wood beam was successfully used as a piling brace for Hurricane Wilma (Category 1). Aluminum I-Beam, channel or any material of similar or additional strength, shape and weather durability may be used. In a preferred embodiment, a piling brace is composed of marine grade aluminum I-Beam. All the SPS 100's preferred embodiment materials were chosen for their ability to endure continuous outdoor exposure and when storm secured, to withstand Category 5 Hurricane force winds analyzed in FEA (Finite Element Analysis) computer simulation.

A cradle bracket 104*a* is mounted to one end of cradle beam 14*a* between piling brace 102*a* and guide pole 18*a*. Cradle brackets 104*b-d* are likewise mounted on the remaining three ends of cradle braces 14*a* and 14*b*. Piling brace 102*a* is secured to each cradle bracket 104*a* and 104*b* with a pair of custom built square U-bolts 106. U-bolts 106 surround piling brace 102*a* and pass through the holes in cradle bracket 104*a*. U-bolts 106 are fastened with common nuts.

In the preferred embodiment, the cradle brackets are made from 4"×⅜" marine grade aluminum rectangular stock constructed here, welded, to durably accommodate the perpendicular attachment of the piling brace to the cradle beam. A gusset is welded to further strengthen the bracket against hurricane force winds. Marine grade stainless steel square U-bolts are custom designed to fit the connection.

A piling pad 108*a* is mounted by lag or through-bolting to piling 10*a* at storm level. Likewise, piling pads 108*b,c*, and *d* are mounted to pilings 10*b,c*, and *d* respectively. Piling brace 102*a* is secured to piling 10*a* at piling pad 108*a*. Piling brace 102*a* is secured at its other end to piling 10*b* at piling pad 108*b*. FIG. 1 exhibits cradle boat lift 8 and SPS 100 secured for storm protection.

Figure 2:
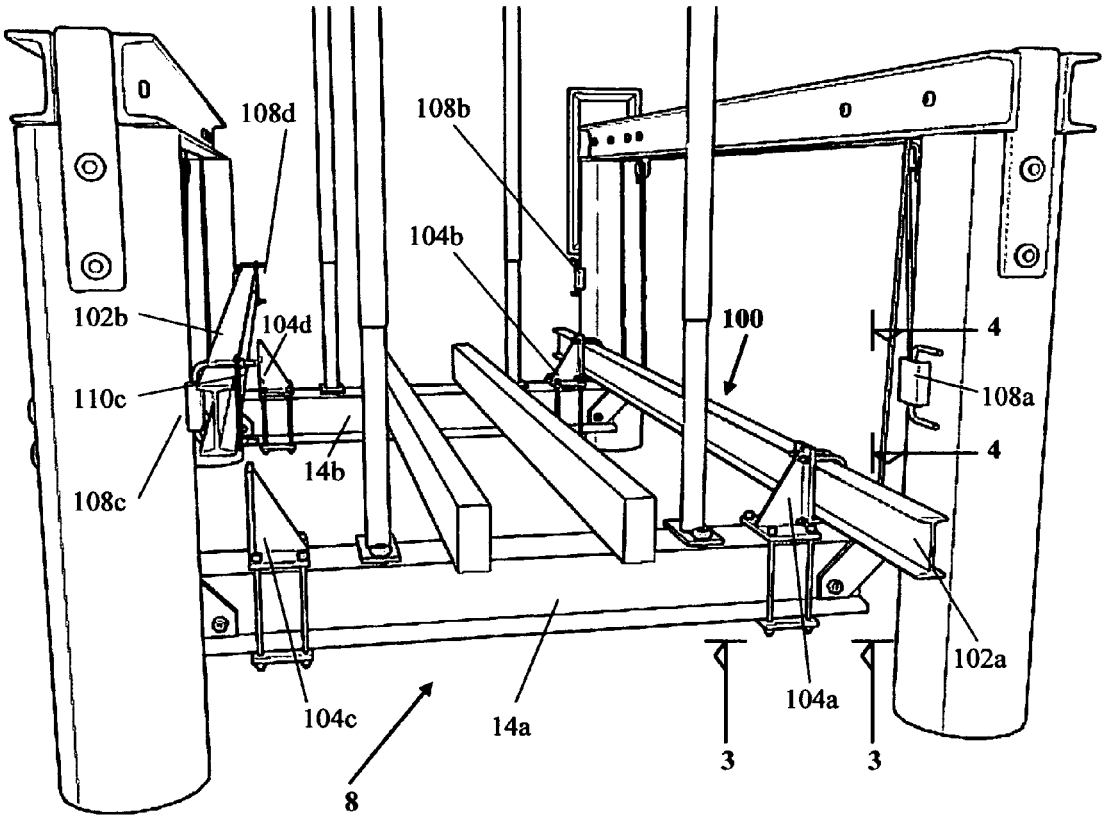
FIG. 2 is a rear view of a cradle boat lift equipped in accordance with the invention, in day to day operating mode.

FIG. 2 is a similar perspective view, seen from the back of a cradle boat lift with Storm Protection System (SPS) installed but in day-to-day operating mode. Piling brace 102*a* lies above and across cradle braces 14*a* and 14*b* attached to cradle brackets 104*a* and 104*b*. The cradle of boat lift 8 rests well below storm level. Piling pad 108*a* is installed, but not in use. The U-bolt of piling pad 108*a* is swung flat to piling 10*a* to avoid undesired interference with piling brace 102*a* when raising the boat lift to storm level. Cradle bracket 104*a* is adjusted at installation to stage piling brace 102*a* with ½" clearance from piling pad 108*a* when aligned at storm level. The same ½" clearance from the piling brace 102*a,b* is provided at all four piling pads 108*a-d*. Additional details on cradle bracket 104*a* and piling pad 108*a* will be given in later figures.

The outboard pilings of FIG. 2 illustrate an alternate arrangement of SPS 100 in fair weather mode. Piling brace 102*b* is fastened to piling pad 108*c*'s U-bolt with a washer plate 110*c* and common nuts. A similar connection exists on piling pad 108*d*. Cradle brackets 104*c* and 104*d* are installed on the outboard end of cradle beams 14*a* and 14*b* respectively with ½" clearance from piling brace 102*b* when boat lift 8 is raised to storm level.

Figure 3:
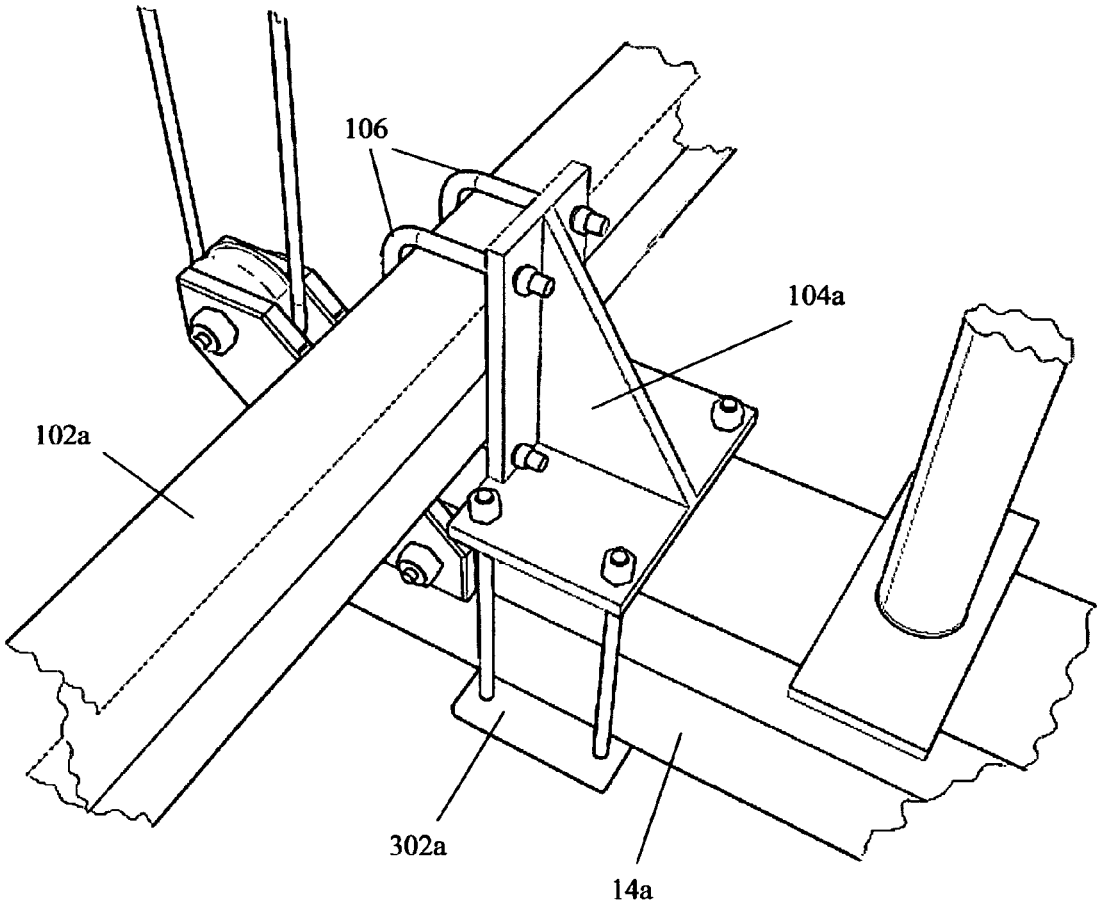
FIG. 3 is a top view along line 3-3 in FIG. 2.

FIG. 3 is a top view along line 3-3 in FIG. 2 of piling brace 102*a* attached to cradle bracket 104*a*. A cradle bracket mounting plate 302*a* provides a way to sandwich cradle bracket 104*a* around cradle beam 14*a* employing four sets of common bolts and nuts. Cradle bracket 104*a* is comprised of a welded bottom plate, vertical plate and gusset. Cradle bracket 104*a* is secured to piling brace 102*a* with any marine grade fastener, for example, bolts, U-bolts, pins or clamps. This view shows the inventor's preferred method, U-bolts 106.

Figure 4:
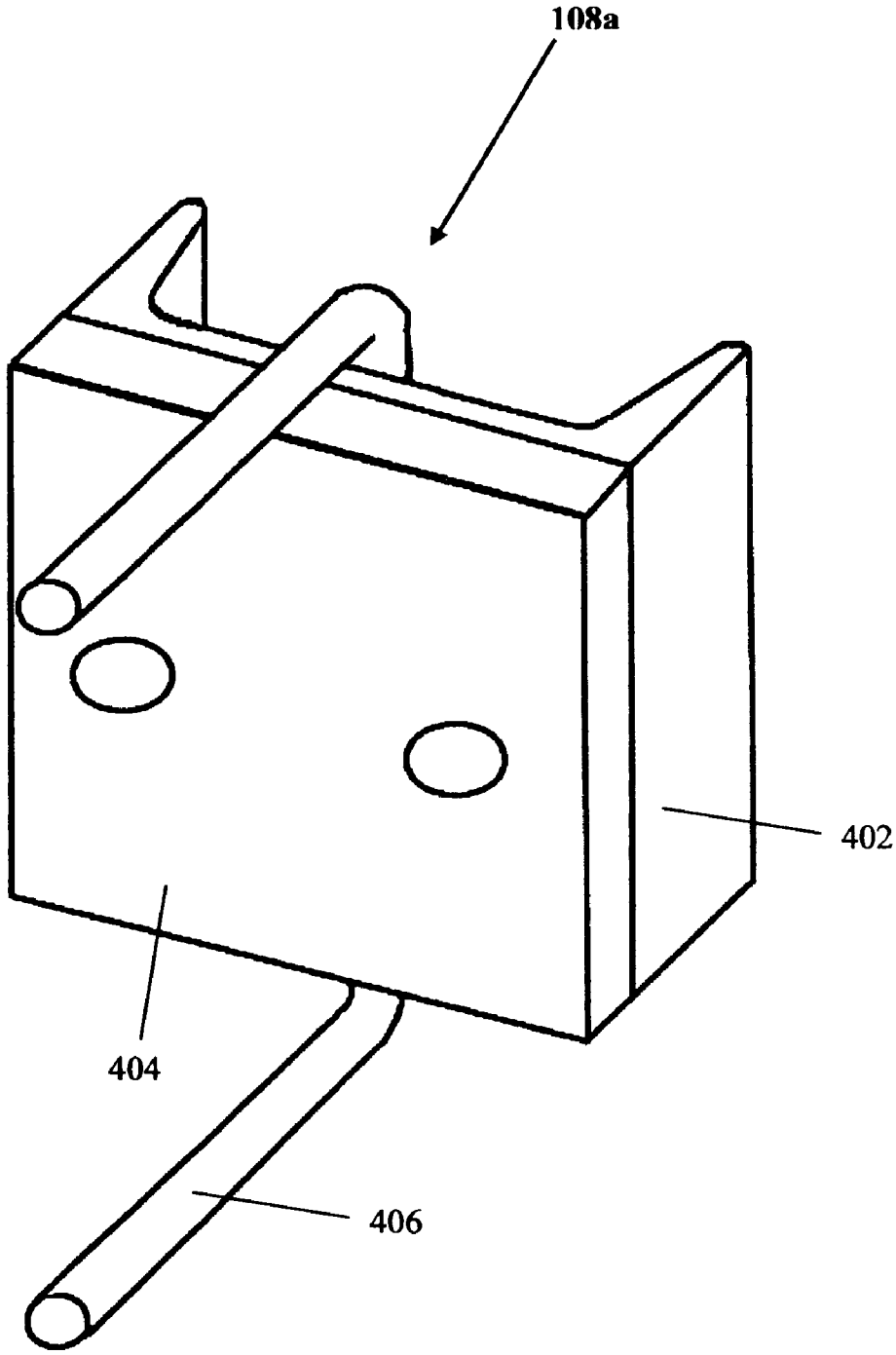
FIG. 4 is a perspective view outward from the center of the boat lift taken along line 4-4 in FIG. 2.

FIG. 4 is a perspective view along line 4-4 on FIG. 2 of piling pad 108*a*. Piling pad 108*a* is comprised of an aluminum channel 402, an extender plate 404 and a U-bolt 406. A thin metal strip, hidden from view, screwed to the bottom of the channel holds U-bolt 406 in place while allowing U-bolt 406 to swing 180 degrees off piling 10*a*. Lag holes are drilled in the aluminum channel for lag attachment to piling 10*a*. Extender plate 404 provides enlarged holes on the front plate of piling pad 108*a* to avoid interference between the lags and piling brace 102*a* when raised to storm level.

Operation—FIGS. 1 and 2

FIG. 1 displays the strengthening power of the SPS 100 on a cradle boat lift. The addition of elongated members of rigid material or I-beam, as piling brace 102*a,b*, secured to each piling 10*a-d* and each cradle beam 14*a,b* fortifies the structure of the boat lift and eliminates the possibility of wind induced swing. The cradle brackets 104*a-d* are easily adjusted at installment or at a later time to adapt to cable changes or realignment of the boat or boat lift.

SPS 100, once installed, is simple to use. Piling braces 102*a,b* remain either attached to cradle brackets 104*a-d* or fastened to piling pads 108*a-d*. The boater may chose where the piling braces 102*a,b* rest in day-to-day mode. Inboard and outboard piling braces 102*a,b* may be fastened the same way, or in different ways as in FIG. 2.

To engage the boat lift into Storm protection mode, simply raise the boat to storm level and use U-bolts 106 on the cradle bracket or the piling pad 108*a-d* U-bolts to secure piling braces 102*a,b* at the four corner connections. The simplest way to disengage the boat lift from storm protection mode is to remove each common bolt and piling pad washer plate 110 from the piling pad 108*a-d* U-bolts, swing the U-bolts aside, and lower the boat lift.

SPS 100 was conceived in the household of a Florida boating family who saw the need to minimize the time and trouble of hurricane preparation. SPS 100 provides a simple, effective, and enduring cradle boat lift storm protection solution. SPS 100 eliminates the questions about what to do about the boat, when hurricane winds are approaching. Boat owners simply strap the boat to the lift, raise the lift to storm level and attach 8 bolts to engage the storm protection system.

CONCLUSION, RAMIFICATIONS, AND SCOPE

Accordingly, the reader will see that the Cradle boat lift Storm Protection System of the invention provides an innovative, simple, and effective means for securing a boat in preparation of hurricane force winds.

While my above description contains detailed specifics, these should not be construed as limitations on the scope of the invention, but rather as an example of one preferred embodiment thereof. Many other variations are possible. Alternative embodiments exist with regard to the placement of the piling brace, design and placement of the cradle bracket, and the types of attachments of these structures to the pilings and the cradle beams. Furthermore, although the preferred embodiment favors connections with the piling brace resting above the cradle beam, the same hurricane ready structure can be achieved with a below the beam connection.

While each piling brace will always attach at storm protection mode to at least one cradle bracket and one piling or piling pad, other placement possibilities will provide storm protection. Additionally, an eight piling boat lift may be best accommodated with four smaller piling braces installed only to the outer pilings. Similarly, six piling boat lifts may be best protected with two large or perhaps four smaller piling braces.

Some cradle boat lifts are designed with an oversized cradle, whereby the cradle beams extend outside of the rectangular array of the pilings. Accordingly, hurricane strength protection can be achieved by extending the piling brace outside of the pilings to attach with the cradle beam.

A pressure treated 2"×6"×12'6" wood beam was successfully used as a piling brace for Hurricane Wilma (Category 1). Aluminum I-Beam, channel or any material of similar or additional strength, shape and weather durability may be used. Although the above detailed embodiment employed piling pads for diversified fair weather configuration, piling braces may also be simply lagged, through-bolted, or otherwise attached to the pilings.

The cradle bracket provides the strong perpendicular attachment of the piling brace to the cradle beam. It would be possible and may be convenient in cases of space restraints to incorporate the cradle bracket and guide pole into a joined structure. Sometimes it may be advantageous to reverse the positioning of the cradle bracket such that the vertical portion of the bracket actually rests outside of the piling brace. The cradle bracket can alternatively be formed of channel welded vertically to a plate aluminum base. Additionally, the cradle bracket may be affixed to the cradle beam by means of clamps, through-bolts, or other similar attachments.

The U-bolts employed in the preferred embodiment perform well in strength testing and ease of use. Other successful means of attaching the piling brace include clamps, bolts, pins, clasps, chains, buckles or other fasteners.

Accordingly, the scope of the invention should be determined not by the embodiment(s) illustrated, but by the appended claims and their legal equivalents.

I claim:

1. A device for temporarily locking a boat lift to prevent unwanted swing of the boat lift, the device comprising:

at least one support element having a length for traversing the horizontal distance between at least two pilings of a boat lift;

at least one bracket configured to be secured to a cradle of the boat lift, said at least one bracket including at least one vertical strut for providing a contiguous connection between said at least one support element and said at least one bracket;

at least two pads, each said pad configured to be mounted to a piling of the boat lift and including a pivotally mounted u-shaped connector positionable to straddle said at least one support element; and at least two washer plates secured to the ends of each said pivotally mounted u-shaped connector for urging said at least one support member into connection with said at least two pads; and wherein said at least one support element is configured to be secured to the boat lift either at said at least one bracket or said pads without impeding the movement of the cradle; and wherein the movement of the cradle is restricted when said device is connected at both the cradle and pilings.

2. The device according to claim 1, wherein each said u-shaped connector is a U-bolt.

3. The device according to claim 2, further including fastening means for securing the ends of the u-shaped connectors.

4. The device according to claim 3, wherein the fastening means comprises a nut.

5. The device according to claim 1, further including fastening means for securing the ends of the u-shaped connectors.

6. The device according to claim 5, wherein the fastening means comprises a nut.

7. The device according to claim 1, wherein said at least one bracket including at least one vertical strut for providing a contiguous connection between said at least one support element and said at least one bracket; further includes a pair of u-shaped connectors surrounding said at least one support element and having end pieces attached to said at least one bracket.

8. The device according to claim 7, wherein said end pieces are nuts.

9. The device according to claim 1, wherein said at least one bracket including at least one vertical strut for providing a contiguous connection between said at least one support element and said at least one bracket; further includes at least one bolt through said at least one support element and having end pieces attached to said at least one bracket.

10. The device according to claim 9, wherein said end pieces are nuts.

* * * * *